US008101033B2

(12) United States Patent
Barnes et al.

(10) Patent No.: US 8,101,033 B2
(45) Date of Patent: Jan. 24, 2012

(54) ALKALI METAL PERCHLORATE-CONTAINING GAS GENERANTS

(75) Inventors: Michael W. Barnes, Brigham City, UT (US); Ivan V. Mendenhall, Providence, UT (US); Robert D. Taylor, Hyrum, UT (US)

(73) Assignee: Autoliv ASP, Inc., Ogden, UT (US)

( * ) Notice: Subject to any disclaimer, the term of this patent is extended or adjusted under 35 U.S.C. 154(b) by 1920 days.

(21) Appl. No.: 10/899,452

(22) Filed: Jul. 26, 2004

(65) Prior Publication Data

US 2006/0016529 A1 Jan. 26, 2006

(51) Int. Cl.

| | |
|---|---|
| ***C06B 31/00*** | (2006.01) |
| ***C06B 29/00*** | (2006.01) |
| ***C06B 29/02*** | (2006.01) |
| ***D03D 23/00*** | (2006.01) |
| ***D03D 43/00*** | (2006.01) |

(52) U.S. Cl. ..... 149/45; 149/75; 149/77; 149/108.4; 149/109.2; 149/109.4

(58) Field of Classification Search ..... 149/45, 149/75, 77, 108.4, 109.2, 109.4
See application file for complete search history.

(56) References Cited

U.S. PATENT DOCUMENTS

| | | | |
|---|---|---|---|
| 5,518,054 | A | 5/1996 | Mitson et al. |
| 5,592,812 | A | 1/1997 | Hinshaw et al. |
| 5,608,183 | A | 3/1997 | Barnes et al. |
| 5,635,668 | A | 6/1997 | Barnes et al. |
| 5,641,938 | A | 6/1997 | Holland et al. |
| 5,663,524 | A | 9/1997 | Bucerius et al. |
| 5,670,740 | A | 9/1997 | Barnes et al. |
| 5,861,571 | A | 1/1999 | Scheffee et al. |
| 5,959,242 | A | 9/1999 | Knowlton et al. |
| 5,970,703 | A | 10/1999 | Hinshaw et al. |
| 6,004,411 | A | 12/1999 | Zeuner et al. |
| 6,045,638 | A | 4/2000 | Lundstrom |
| 6,051,158 | A | 4/2000 | Taylor et al. |
| 6,077,372 | A | 6/2000 | Mendenhall et al. |

(Continued)

FOREIGN PATENT DOCUMENTS

| | | |
|---|---|---|
| DE | 44 42 169 | 12/1995 |

(Continued)

OTHER PUBLICATIONS

U.S. Appl. No. 10/899,451, filed Jul. 2004, Barnes et al.*

*Primary Examiner* — Jerry Lorengo
(74) *Attorney, Agent, or Firm* — Sally J. Brown; Pauley, Petersen & Erickson

(57) ABSTRACT

Alkali metal perchlorate-containing gas generant compositions which, upon combustion, produce or result in an improved effluent and related methods for generating an inflation gas for use in an inflatable restraint system are provided. Such alkali metal perchlorate-containing gas generant compositions include at least one alkali metal perchlorate present with a mean particle size in excess of 100 microns. Such alkali metal perchlorate-containing gas generant compositions also include or contain a suitable non-azide, organic, nitrogen-containing fuel and at least one copper-containing compound selected from the group consisting of basic copper nitrate, cupric oxide, copper diammine dinitrate-ammonium nitrate mixture wherein ammonium nitrate is present in the mixture in a range of about 3 to about 90 weight percent, copper diammine bitetrazole, a copper-nitrate complex resulting from reaction of 5-aminotetrazole with basic copper nitrate and combinations thereof.

14 Claims, 1 Drawing Sheet

U.S. PATENT DOCUMENTS

| | | | | |
|---|---|---|---|---|
| 6,096,147 | A | 8/2000 | Taylor et al. | |
| 6,103,030 | A | 8/2000 | Taylor et al. | |
| 6,132,537 | A * | 10/2000 | Zeuner et al. | 149/45 |
| 6,132,538 | A | 10/2000 | Mendenhall et al. | |
| 6,143,102 | A | 11/2000 | Mendenhall et al. | |
| 6,241,281 | B1 | 6/2001 | Hinshaw et al. | |
| 6,340,401 | B1 | 1/2002 | Wheatley et al. | |
| 6,410,682 | B1 | 6/2002 | Blomquist | |
| 6,436,211 | B1 | 8/2002 | Mendenhall et al. | |
| 6,517,647 | B1 * | 2/2003 | Yamato | 149/45 |
| 6,592,691 | B2 * | 7/2003 | Taylor et al. | 149/45 |
| 6,689,237 | B1 * | 2/2004 | Mendenhall | 149/36 |
| 6,712,918 | B2 | 3/2004 | Mendenhall et al. | |
| 2003/0097953 | A1 * | 5/2003 | Serizawa et al. | 102/531 |
| 2003/0145921 | A1 | 8/2003 | Blomquist et al. | |
| 2004/0200554 | A1 | 10/2004 | Mendenhall et al. | |

FOREIGN PATENT DOCUMENTS

| | | |
|---|---|---|
| DE | 102 30 402 A1 | 1/2004 |
| WO | 99/31029 | 6/1999 |

* cited by examiner

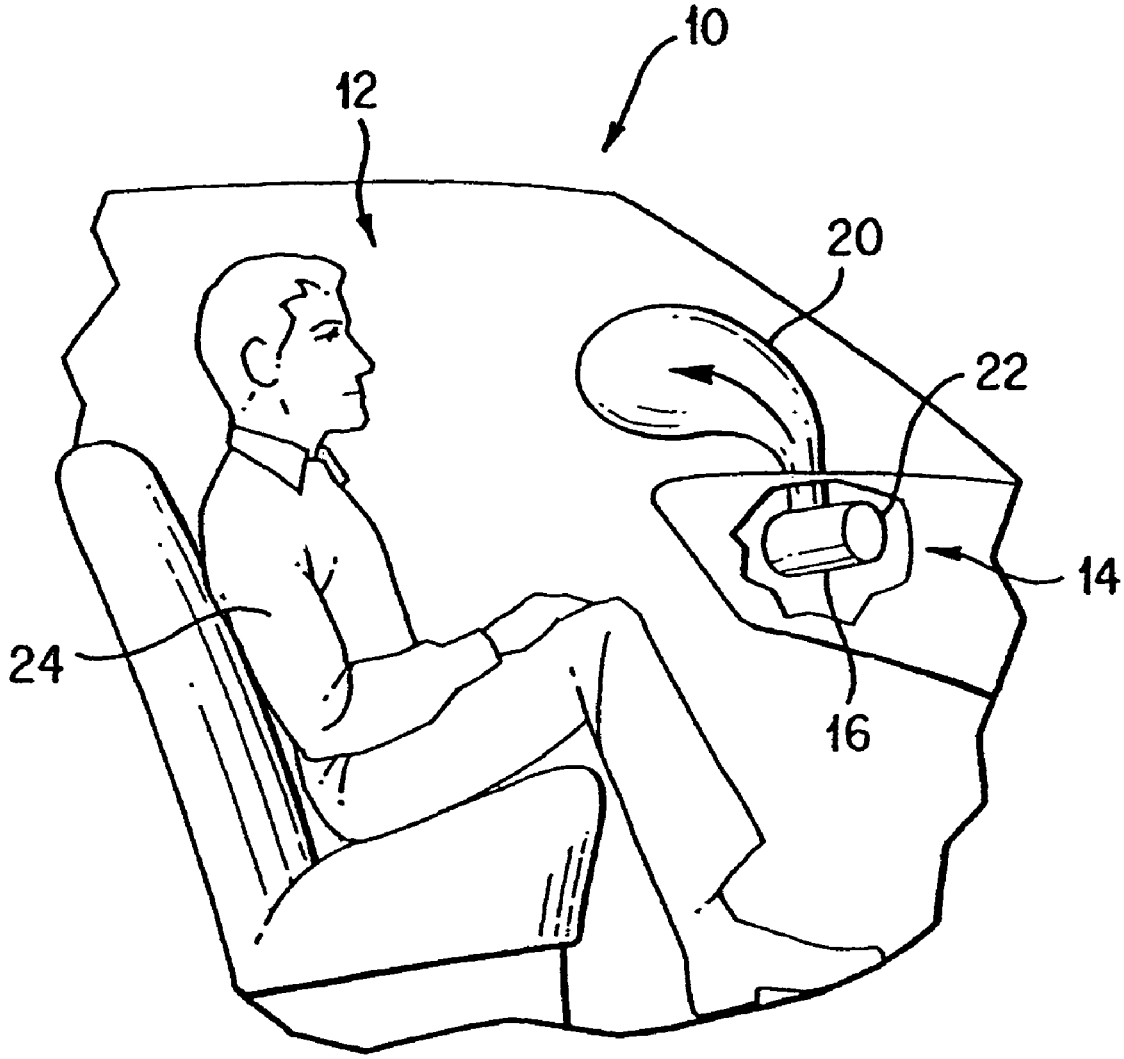
FIGURE

ALKALI METAL PERCHLORATE-CONTAINING GAS GENERANTS

BACKGROUND OF THE INVENTION

This invention relates generally to gas generation and, more particularly, to gas generation via alkali metal perchlorate-containing gas generant compositions which produce or result in gaseous effluents having reduced levels of various undesirable constituent.

It is well known to protect a vehicle occupant using a cushion or bag, e.g., an "airbag cushion" that is inflated or expanded with a gas when a vehicle experiences a sudden deceleration, such as in the event of a collision. Such airbag restraint systems normally include: one or more airbag cushions, housed in an uninflated and folded condition to minimize space requirements; one or more crash sensors mounted on or to the frame or body of the vehicle to detect sudden deceleration of the vehicle; an activation system electronically triggered by the crash sensors; and an inflator device that produces or supplies a gas to inflate the airbag cushion. In the event of a sudden deceleration of the vehicle, the crash sensors trigger the activation system which in turn triggers the inflator device which begins to inflate the airbag cushion, typically, in a matter of milliseconds.

Many types of inflator devices have been disclosed in the art for inflating one or more inflatable restraint system airbag cushions. Inflator devices which form or produce inflation gas via the combustion of a gas generating pyrotechnic material, e.g., a "gas generant," are well known. For example, inflator devices that use the high temperature combustion products, including additional gas products, generated by the burning of the gas generant to supplement stored and pressurized gas to inflate one or more airbag cushions are known. In other known inflator devices, the combustion products generated by burning the gas generant may be the sole or substantially sole source for the inflation gas used to inflate the airbag cushion. Typically, such inflator devices include a filter to remove dust or particulate matter formed during the combustion of a gas generant composition from the inflation gas to limit or prevent occupant exposure to undesirable and/or toxic combustion byproducts.

In view of an increased focus on passenger safety and injury prevention, many automotive vehicles typically include several inflatable restraint systems, each including one or more inflator devices. For example, a vehicle may include a driver airbag, a passenger airbag, one or more seat belt pretensioners, one or more knee bolsters, and/or one or more inflatable belts, each with an associated inflator device, to protect the driver and passengers from frontal crashes. The vehicle may also include one or more head/thorax cushions, thorax cushions, and/or curtains, each with at least one associated inflator device, to protect the driver and passengers from side impact crashes. Generally, the gaseous effluent or inflation gas produced by all of the inflator devices within a particular vehicle, when taken as whole, are required to satisfy strict content limitations in order to meet current industry safety guidelines. Thus, it is desired that the gas generant compositions used in such inflator devices produce as little as possible of undesirable effluents such as hydrogen chloride, carbon monoxide, ammonia, nitrogen dioxide and nitric oxide.

There is a need and a demand for gas generant compositions which produce or result in desirably low levels of undesirable effluents such as hydrogen chloride, carbon monoxide, ammonia, nitrogen dioxide and nitric oxide. While the manipulation of the equivalence ratio of gas generant materials is a technique commonly used to adjust the effluent levels of gas generant materials, such manipulation is prone to performance sometimes referred to as the equivalence ratio "teeter-totter". That is, as the equivalence ratio is lowered, under-oxidized species, such as CO and $NH_3$, increase and over-oxidized species, such as NO and $NO_2$, decrease. The reverse is true when the equivalence ratio is increased.

In view of the above, there is a need and a demand for pyrotechnic gas generant compositions that, when employed in an airbag inflator device, produce a gas effluent that is substantially free of undesired gaseous effluents such as carbon monoxide, ammonia, nitrogen dioxide and nitric oxide.

SUMMARY OF THE INVENTION

A general object of the invention is to provide an improved gas generant composition.

A more specific objective of the invention is to overcome one or more of the problems described above.

The general object of the invention can be attained, at least in part, through a gas generant composition comprising:

- a non-azide, organic, nitrogen-containing fuel;
- at least one copper-containing compound selected from the group consisting of basic copper nitrate, cupric oxide, copper diammine dinitrate-ammonium nitrate mixture wherein ammonium nitrate is present in the mixture in a range of about 3 to about 90 weight percent, copper diammine bitetrazole, a copper-nitrate complex resulting from reaction of 5-aminotetrazole with basic coppernitrate and combinations thereof; and
- a quantity of at least one alkali metal perchlorate with a mean particle size in excess of 100 microns, the at least one alkali metal perchlorate being present in a relative amount of about 1 to about 10 composition weight percent and effective to result in a gaseous effluent that is substantially free of hydrogen chloride, carbon monoxide, ammonia, nitrogen dioxide and nitric oxide, when the gas generant composition is combusted.

The prior art generally fails to provide gas generant compositions that facilitate or otherwise permit the inclusion of one or more alkali metal perchlorate while simultaneously inhibiting the formation or otherwise reducing the amounts or levels of undesirable effluents such as hydrogen chloride, carbon monoxide, ammonia, nitrogen dioxide and nitric oxide.

The invention further comprehends a gas generant composition comprising:

- a non-azide, organic, nitrogen-containing fuel,
- a copper-containing compound selected from the group consisting of basic copper nitrate, cupric oxide, copper diammine dinitrate-ammonium nitrate mixture wherein ammonium nitrate is present in the mixture in a range of about 3 to about 90 weight percent, copper diammine bitetrazole, a copper-nitrate complex resulting from reaction of 5-aminotetrazole with basic copper nitrate and combinations thereof;
- about 1 to about 10 composition weight percent alkali metal perchlorate in a mean particle size in excess of 100 microns and
- about 1 to about 5 composition weight percent of at least one metal oxide burn rate enhancing and slag formation additive selected from the group consisting of silicon dioxide, aluminum oxide, zinc oxide, and combinations thereof,
- wherein the non-azide, organic, nitrogen-containing fuel, the copper-containing compound, the alkali metal perchlorate and metal oxide burn rate enhancing and slag formation additive are present in sufficient relative amounts that the gas generant composition has an equivalence ratio in the range of about 0.95 to about 1.05, and wherein combustion of the gas generant composition results in a gaseous effluent that is substantially free of hydrogen chloride, carbon monoxide, ammonia, nitrogen dioxide and nitric oxide.

The invention still further comprehends a method for reducing effluent toxicity produced upon combustion of a gas generant composition that includes a non-azide, organic, nitrogen-containing fuel, the method comprising:

including about 1 to about 10 composition weight percent alkali metal perchlorate in a mean particle size in excess of 100 microns heterogenously within the gas generant composition.

As used herein, the term "equivalence ratio" is understood to refer to the ratio of the number of moles of oxygen in a gas generant composition or formulation to the number of moles needed to convert hydrogen to water, carbon to carbon dioxide, and any metal to the thermodynamically predicted metal oxide. Thus, a gas generant composition having an equivalence ratio greater than 1.0 is over-oxidized, a gas generant composition having an equivalence ratio less than 1.0 is under-oxidized, and a gas generant composition having an equivalence ratio equal to 1.0 is perfectly oxidized.

As used herein, the expression "substantially free of", as used herein in reference to possible gaseous effluent constituents such as hydrogen chloride, carbon monoxide, ammonia, nitrogen dioxide and nitric oxide similarly refer to a gaseous effluent or inflation gas that includes such constituent in an amount that is equal to or less than an amount of such constituent permitted by or allowed under current industry standards (USCAR specifications). For example, if a vehicle includes a single inflatable airbag cushion with a single inflator including a gas generant composition, the gaseous effluent or inflation gas produced by the combustion of the gas generant composition is substantially free of hydrogen chloride if it includes about 5 parts per million hydrogen chloride or less when the inflator is discharged into a 100 $ft^3$ tank; is substantially free of carbon monoxide if it includes about 461 parts per million carbon monoxide or less when the inflator is discharged into a 100 $ft^3$ tank; is substantially free of ammonia if it includes about 35 parts per million ammonia or less when the inflator is discharged into a 100 $ft^3$ tank; is substantially free of nitrogen dioxide if it includes about 5 parts per million nitrogen dioxide or less when the inflator is discharged into a 100 $ft^3$ tank; and is substantially free of nitric oxide if it includes about 75 parts per million nitric oxide or less when the inflator is discharged into a 100 $ft^3$ tank.

Other objects and advantages will be apparent to those skilled in the art from the following detailed description taken in conjunction with the appended claims and drawing.

BRIEF DESCRIPTION OF THE DRAWING

The FIGURE is a simplified schematic, partially broken away, view illustrating the deployment of an airbag cushion from an airbag module assembly within a vehicle interior, in accordance with one embodiment of the invention.

DETAILED DESCRIPTION OF THE INVENTION

The present invention provides an improved gas generant composition. More specifically, it has been discovered that a gas generant effluent product can be dramatically improved (e.g., the resulting effluent has a significantly reduced content of undesirable materials such as one or more of hydrogen chloride, carbon monoxide, ammonia, nitrogen dioxide and nitric oxide) via the inclusion, in the gas generant composition, of one or more alkali metal perchlorate in particles of sufficient particle size. More specifically, it has been found that the inclusion, in a gas generant composition, of alkali metal perchlorate particles having a mean particle size in excess of 100 microns and, preferably, a mean particle size of at least about 200 microns can dramatically improve the effluent resulting from the combustion of a gas generant composition which includes such sized alkali metal perchlorate particles, as compared to the effluent resulting from the combustion of the same gas generant composition but without the so sized alkali metal perchlorate particles. In accordance with at least certain preferred embodiments of the invention, it has been found advantageous that alkali metal perchlorate particles included in gas generant compositions in accordance with the invention have a mean particle size in the range of about 350 to about 450 microns.

As identified above, the reduction in content of undesirable materials such as one or more of hydrogen chloride, carbon monoxide, ammonia, nitrogen dioxide and nitric oxide) upon combustion of the gas generant compositions in accordance with the invention is believed dependent on the inclusion, in the gas generant composition, of one or more alkali metal perchlorate in sufficiently sized particles. That is, the reduction in content of such undesirable materials has not been observed upon the simple inclusion of an alkali metal perchlorate as an ingredient of a homogeneous gas generant composition, rather alkali metal perchlorate particles, sized as herein described, must be incorporated within a gas generant composition.

It is theorized that the larger the particle size of the alkali metal perchlorate incorporated into a gas generant composition of the invention, the higher the degree of heterogeneity resulting therefrom and, consequently, the more or greater the effect realized on effluent toxicity as a result of the inclusion of the sized alkali metal perchlorate particles in a particular gas generant composition, in accordance with the invention. It is further theorized that with the use of alkali metal perchlorate particles with a mean particle size of less than 100 microns, effectiveness is reduced as the resulting alkali metal perchlorate-containing gas generant composition becomes more homogeneous.

Suitable alkali metal perchlorates for use in the practice of the invention include perchlorates of lithium, sodium, potassium, rubidium and cesium. In practice, sodium perchlorate and potassium perchlorate are believed to be particularly desirable alkali metal perchlorates for use in the practice of the invention based on performance and cost with the use of potassium perchlorate being particularly preferred, at least in part as a result of the lower hygroscopicity associated therewith.

Particularly suited gas generant compositions for use in the practice of the invention are gas generant compositions that include a non-azide, organic, nitrogen-containing fuel. Useful nitrogen-containing fuels for use in the precursor blend generally include non-azide, organic, nitrogen-containing fuels such as include: amine nitrates, nitramines, heterocyclic nitro compounds, tetrazole compounds, and combinations thereof. While various nitrogen-containing fuels may be used in the chlorine-containing gas generant compositions of the invention, in accordance with certain preferred embodiments, the nitrogen-containing fuel may advantageously be guanidine nitrate. Generally, guanidine nitrate may be desirable due to its good thermal stability, low cost and high gas yield when combusted.

Particularly suited gas generant compositions for use in the practice of the invention are gas generant compositions that further include at least one copper-containing compound selected from the group consisting of basic copper nitrate, cupric oxide, copper diammine dinitrate-ammonium nitrate mixture wherein ammonium nitrate is present in the mixture in a range of about 3 to about 90 weight percent, copper diammine bitetrazole, a copper-nitrate complex resulting from reaction of 5-aminotetrazole with basic copper nitrate and combinations thereof. As will be appreciated by those skilled in the art and guided by the teachings herein provided, such included copper-containing compounds can serve one or more or various functions within a particular composition. For example, in particular compositions, particular such copper-containing compounds can function or serve as an oxidizer, fuel or burn rate catalyst or enhancer, for example. Moreover, the selection and use of a particular such copper-containing compound oftentimes involves a balance between cost and performance.

If desired, a gas generant composition in accordance with the invention may advantageously also contain at least one metal oxide burn rate enhancing and slag formation additive. Such metal oxide additives may be added to enhance the burn rate of the gas generant composition or may be added to assist in the removal of undesirable combustion byproducts by forming filterable particulate material or slag. In practice, the gas generant compositions of the present invention may include up to about 10 composition weight percent of at least one such metal oxide additive. Suitable metal oxide additives include, but are not limited to, silicon dioxide, aluminum oxide, zinc oxide, and combinations thereof. In accordance with certain preferred embodiments of the invention, the gas generant compositions of the present invention desirably include about 1 to about 5 composition weight percent of at least one such metal oxide additive. Gas generant compositions in accordance with certain preferred embodiments of the invention desirably contain about 1.5 to about 5 composition weight percent of aluminum oxide metal oxide burn rate enhancing and slag formation additive and up to about 1 composition weight percent of silicon dioxide metal oxide burn rate enhancing and slag formation additive.

In practice, it has been found desirable that gas generant compositions in accordance with this aspect of the invention desirably include the desirably-sized alkali metal perchlorate particles in a relative amount of about 1 to about 10 composition weight percent.

Gas generant compositions having equivalence ratios in the range of about 0.95 to about 1.05, preferably in the range of about 0.99 to about 1.04, have been found desirable in improving product effluent such as in reducing or minimizing the amount of undesirable gas species such as carbon monoxide, ammonia, nitrogen dioxide and nitric oxide, for example.

Suitable gas generant compositions in accordance with the invention include:

1. a composition, alternatively, comprising, consisting and consisting essentially of:
   - about 40 to about 60 composition weight percent guanidine nitrate;
   - about 35 to about 50 composition weight percent basic copper nitrate;
   - about 1 to about 10 composition weight percent alkali metal perchlorate in a mean particle size in excess of 100 microns; and
   - about 1 to about 5 composition weight percent of metal oxide burn rate enhancing and slag formation additive;
2. a composition, alternatively, comprising, consisting and consisting essentially of:
   - about 40 to about 50 composition weight percent guanidine nitrate;
   - about 40 to about 55 composition weight percent copper diammine dinitrate-ammonium nitrate mixture wherein ammonium nitrate is present in the mixture in a range of about 3 to about 90 weight percent;
   - about 1 to about 10 composition weight percent alkali metal perchlorate in a mean particle size in excess of 100 microns; and
   - about 1 to about 5 composition weight percent of metal oxide burn rate enhancing and slag formation additive;
3. a composition, alternatively, comprising, consisting and consisting essentially of:
   - about 10 to about 40 composition weight percent guanidine nitrate;
   - about 45 to about 60 composition weight percent basic copper nitrate;
   - about 5 to about 30 composition weight percent copper diammine bitetrazole;
   - about 1 to about 10 composition weight percent alkali metal perchlorate in a mean particle size in excess of 100 microns;
   - about 1 to about 5 composition weight percent of at least one metal oxide burn rate enhancing and slag formation additive; and
4. a composition, alternatively, comprising, consisting and consisting essentially of:
   - about 10 to about 60 composition weight percent guanidine nitrate;
   - about 1 to about 35 composition weight percent basic copper nitrate;
   - about 10 to about 60 composition weight percent of a copper-nitrate complex resulting from reaction of 5-aminotetrazole with basic copper nitrate;
   - about 1 to about 10 composition weight percent alkali metal perchlorate in a mean particle size in excess of 100 microns; and
   - about 1 to about 5 composition weight percent of at least one metal oxide burn rate enhancing and slag formation additive.

In particular, the copper-nitrate complex resulting from reaction of 5-aminotetrazole with basic copper nitrate is believed to be a copper, hydroxy nitrate 1H-tetrazol-5-amine complex.

Various preparation techniques, such as known in the art, can be used to prepare the gas generant compositions in accordance with invention. For example, the various gas generant composition compounds (other than the alkali metal perchlorate) can be prepared such as by slurry mixing, followed by spray drying to form a homogeneous powder. Such a homogeneous powder can then be blended with the desired size alkali metal perchlorate particles using a low energy input mixer such as to retain the alkali metal perchlorate in the desired particle size. The resulting blend can then be appropriately processed, such as by tableting, for example, to form the composition into specifically desired shapes or forms.

While those skilled in the art and guided by the teachings herein provided will appreciate that various preparation techniques, such as known in the art, can be used to prepare the gas generant compositions in accordance with invention, practice of the invention generally requires that the final gas generant composition include the alkali metal perchlorate particles in the specified size range.

The invention further comprehends methods for inflating an airbag cushion of an inflatable restraint system of a motor vehicle including the steps of igniting a gas generant composition in accordance with the invention to produce a quantity of inflation gas and then inflating the airbag cushion with the inflation gas. As will be appreciated, the inflation gas is substantially free of hydrogen chloride, carbon monoxide, ammonia, nitrogen dioxide and nitric oxide.

As will be appreciated, gas generating compositions in accordance with the invention can be incorporated, utilized or practiced in conjunction with a variety of different structures, assemblies and systems. As representative, the FIGURE illustrates a vehicle 10 having an interior 12 wherein an inflatable vehicle occupant safety restraint system, generally designated by the reference numeral 14, is positioned. As will be appreciated, certain standard elements not necessary for an understanding of the invention may have been omitted or removed from the FIGURE for purposes of facilitating illustration and comprehension.

The vehicle occupant safety restraint system 14 includes an open-mouthed reaction canister 16 which forms a housing for an inflatable vehicle occupant restraint 20, e.g., an inflatable airbag cushion, and an apparatus, generally designated by the reference numeral 22, for generating or supplying inflation gas for the inflation of an associated occupant restraint. As identified above, such a gas generating device is commonly referred to as an "inflator."

The inflator 22 contains a quantity of a gas generant composition in accordance with the invention and such as described above. The inflator 22 also includes an ignitor, such as known in the art, for initiating combustion of the gas generating composition in ignition communication with the gas generant composition. As will be appreciated, the specific construction of the inflator device does not form a limitation on the broader practice of the invention and such inflator devices can be variously constructed such as is also known in the art.

In practice, the airbag cushion 20 upon deployment desirably provides for the protection of a vehicle occupant 24 by restraining movement of the occupant in a direction toward the front of the vehicle, i.e., in the direction toward the right as viewed in the FIGURE.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Comparative Example 1 and Example 1

For each of these tests, the compositions shown in TABLE 1 (compound values in terms of "composition wt %"), were prepared.

TABLE 1

| COMPOUND (wt. %) | COMPARATIVE EXAMPLE 1 | EXAMPLE 1 |
|---|---|---|
| $GuNO_3$ | 43.79 | 40.67 |
| CDDN | 46.11 | 45.63 |
| AN | 5.00 | 4.8 |
| $SiO_2$ | 5.10 | 4.9 |
| KP (200μ) | na | 4 |
| Properties | | |

TABLE 1-continued

| COMPOUND (wt. %) | COMPARATIVE EXAMPLE 1 | EXAMPLE 1 |
|---|---|---|
| ER | 1.00 | 1.00 |

where,
$GuNO_3$ = guanidine nitrate;
CDDN = copper diammine dinitrate;
AN = ammonium nitrate;
KP = potassium perchlorate;
na = not applicable; and
ER = equivalence ratio.

More specifically, the guanidine nitrate, ammonium nitrate, copper diammine dinitrate and silicon dioxide were slurry mixed and then spray dried to form a powder precursor. In Example 1, the desired size potassium perchlorate particles were blended with the powder precursor using a low energy input mixer such as to retain the alkali metal perchlorate in the desired particle size. The resulting blend was then appropriately tableted using common tableting processing.

The tableted compositions were evaluated using a standard test apparatus hardware wherein each of the compositions was combusted and discharged into a 100 cubic foot tank. Three runs were made using the compositions of Comparative Example 1 and Example 1, respectively. The resulting gaseous effluent for each run was tested by FTIR to identify and quantify the trace species present in the effluent, the species levels (ppm) for each of the compositions, averaged for the three runs, are shown in TABLE 2. Also shown in TABLE 2 are the USCAR specifications for each of the listed constituents.

TABLE 2

| | COMPARATIVE EXAMPLE 1 | EXAMPLE 1 | USCAR |
|---|---|---|---|
| CO | 450 | 350 | 461 |
| $NH_3$ | 0 | 0 | 35 |
| NO | 176 | 73 | 75 |
| $NO_2$ | 37 | 1 | 5 |
| HCl | 0 | 0 | 5 |

Discussion of Results

As shown in TABLE 2, the gas generant composition inclusion of 200 mean particle size potassium perchlorate resulted in a dramatic reduction in effluent levels of CO, NO and $NO_2$, while maintaining the effluent levels of ammonia and HCl as negligible, with the effluent produced using the gas generant composition of Example 1 satisfying the USCAR specifications for each of CO, $NH_3$, NO, $NO_2$, and HCl.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional. embodiments and that certain of the details described herein can be varied considerably without departing from the basic principles of the invention.

What is claimed is:

1. A gas generant composition comprising: a non-azide, organic, nitrogen-containing fuel; at least one copper-containing compound selected from the group consisting of basic copper nitrate, cupric oxide, copper diammine dinitrate-ammonium nitrate mixture wherein ammonium nitrate is present in the mixture in a range of about 3 to about 90 weight percent, copper diammine bitetrazole, a copper-nitrate complex resulting from reaction of 5 aminotetrazole with basic copper nitrate and combinations thereof; and a quantity of at least one alkali metal perchlorate with a mean particle size in excess of 100 microns, the at least one alkali metal perchlorate being present in a relative-amount of about 1 to about 10 composition weight percent and effective—to result in a gaseous effluent that is substantially free of hydrogen chloride, carbon monoxide, ammonia, nitrogen dioxide and nitric oxide, when the gas generant composition is combusted, said composition consisting essentially of:

about 40 to about 60 composition weight percent guanidine nitrate;

about 35 to about 50 composition weight percent basic copper nitrate;

about 1 to about 10 composition weight percent alkali metal perchlorate in a mean particle size in excess of 100 microns; and about 1 to about 5 composition weight percent of metal oxide burn rate enhancing and slag formation additive.

2. A gas generant composition comprising: a non-azide, organic, nitrogen-containing fuel; at least one copper-containing compound selected from the group consisting of basic copper nitrate, cupric oxide, copper diammine dinitrate-ammonium nitrate mixture wherein ammonium nitrate is present in the mixture in a range of about 3 to about 90 weight percent, copper diammine bitetrazole, a copper-nitrate complex resulting from reaction of 5 aminotetrazole with basic copper nitrate and combinations thereof; and a quantity of at least one alkali metal perchlorate with a mean particle size in excess of 100 microns, the at least one alkali metal perchlorate being present in a relative-amount of about 1 to about 10 composition weight percent and effective—to result in a gaseous effluent that is substantially free of hydrogen chloride, carbon monoxide, ammonia, nitrogen dioxide and nitric oxide, when the gas generant composition is combusted, wherein the composition comprises:

about 10 to about 60 composition weight percent guanidine nitrate;

about 1 to about 35 composition weight percent basic copper nitrate;

about 10 to about 60 composition weight percent a copper-nitrate complex resulting from reaction of 5-aminotetrazole with basic copper nitrate;

about 1 to about 10 composition weight percent alkali metal perchlorate in a mean particle size in excess of 100 microns;

about 1 to about 5 composition weight percent of at least one metal oxide burn rate enhancing and slag formation additive.

3. A gas generant composition comprising: a non-azide, organic, nitrogen-containing fuel; at least one copper-containing compound selected from the group consisting of basic copper nitrate, cupric oxide, copper diammine dinitrate-ammonium nitrate mixture wherein ammonium nitrate is present in the mixture in a range of about 3 to about 90 weight percent, copper diammine bitetrazole, a copper-nitrate complex resulting from reaction of 5 aminotetrazole with basic copper nitrate and combinations thereof; and a quantity of at least one alkali metal perchlorate with a mean particle size in excess of 100 microns, the at least one alkali metal perchlorate being present in a relative-amount of about 1 to about 10 composition weight percent and effective—to result in a gaseous effluent that is substantially free of hydrogen chloride, carbon monoxide, ammonia, nitrogen dioxide and nitric oxide, when the gas generant composition is combusted, said composition consisting essentially of:

about 40 to about 60 composition weight percent guanidine nitrate;

about 35 to about 50 composition weight percent basic copper nitrate;

about 1 to about 10 composition weight percent alkali metal perchlorate in a mean particle size in excess of 100 microns; and about 1 to about 5 composition weight percent of metal oxide.

4. A gas generant composition comprising: a non-azide, organic, nitrogen-containing fuel; at least one copper-containing compound selected from the group consisting of basic copper nitrate, cupric oxide, copper diammine dinitrate-ammonium nitrate mixture wherein ammonium nitrate is present in the mixture in a range of about 3 to about 90 weight percent, copper diammine bitetrazole, a copper-nitrate complex resulting from reaction of 5 aminotetrazole with basic copper nitrate and combinations thereof; and a quantity of at least one alkali metal perchlorate with a mean particle size in excess of 100 microns, the at least one alkali metal perchlorate being present in a relative-amount of about 1 to about 10 composition weight percent and effective—to result in a gaseous effluent that is substantially free of hydrogen chloride, carbon monoxide, ammonia, nitrogen dioxide and nitric oxide, when the gas generant composition is combusted, wherein the composition comprises:

about 10 to about 60 composition weight percent guanidine nitrate;

about 1 to about 35 composition weight percent basic copper nitrate;

about 10 to about 60 composition weight percent a copper-nitrate complex resulting from reaction of 5-aminotetrazole with basic copper nitrate;

about 1 to about 10 composition weight percent alkali metal perchlorate in a mean particle size in excess of 100 microns;

about 1 to about 5 composition weight percent of at least one metal oxide burn rate enhancing and slag formation additive.

5. A method for generating an inflation gas for inflating an airbag cushion of an inflatable restraint system of a motor vehicle comprising the steps of:

igniting a gas generant composition comprising a non-azide, organic, nitrogen-containing fuel, a copper-containing compound selected from the group consisting of basic copper nitrate, cupric oxide, copper diammine dinitrate-ammonium nitrate mixture wherein ammonium nitrate is present in the mixture in a range of about 3 to about 90 weight percent, copper diammine bitetrazole, a copper-nitrate complex resulting from reaction of 5-aminotetrazole with basic copper nitrate and combinations thereof; about 1 to about 10 composition weight percent alkali metal perchlorate in a mean particle size in excess of 100 microns and about 1 to about 5 composition weight percent of at least one metal oxide burn rate enhancing and slag formation additive selected from the group consisting of silicon dioxide, aluminum oxide, zinc oxide, and combinations thereof, wherein the non-azide, organic, nitrogen containing fuel, the copper-containing compound, the alkali metal perchlorate and metal oxide burn rate enhancing and slag formation additive are present in sufficient relative amounts that the gas generant composition has an equivalence ratio in the range of about 0.95 to about 1.05, and wherein combustion of the gas generant composition results in a gaseous effluent that is substantially free of hydrogen chloride, carbon monoxide, ammonia, nitrogen dioxide and nitric oxide to produce a quantity of inflation gas; and inflating the airbag cushion with the inflation gas.

6. A method for reducing effluent toxicity produced upon combustion of a gas generant composition that includes a non-azide, organic, nitrogen-containing fuel, the method comprising:

including about 1 to about 10 composition weight percent alkali metal perchlorate in a mean particle size in excess of 100 microns heterogenously within the gas generant composition.

7. The method of claim 6 wherein the gas generant composition additionally comprises at least one copper-containing compound selected from the group consisting of basic copper nitrate, cupric oxide, copper diammine dinitrate-ammonium nitrate mixture wherein ammonium nitrate is present in the mixture in a range of about 3 to about 90 weight percent, copper diammine bitetrazole, a copper-nitrate complex resulting from reaction of 5-aminotetrazole with basic copper nitrate and combinations thereof.

8. The method of claim 6 wherein the inclusion of the alkali metal perchlorate in the gas generant composition results in an effluent, upon combustion of the gas generant composition, having a reduced relative amount of at least one effluent constituent selected from the group consisting of hydrogen chloride, carbon monoxide, ammonia, nitrogen dioxide and nitric oxide.

9. The method of claim 6 wherein the inclusion of the alkali metal perchlorate in the gas generant composition results in an effluent, upon combustion of the gas generant composition, substantially free of hydrogen chloride, carbon monoxide, ammonia, nitrogen dioxide and nitric oxide.

10. The method of claim 6 wherein the alkali metal perchlorate is potassium perchlorate.

11. The method of claim 6 wherein the alkali metal perchlorate is sodium perchlorate.

12. The method of claim 6 wherein the alkali metal perchlorate is included in the gas generant composition in a mean particle size of at least about 200 microns.

13. The method of claim 6 wherein the alkali metal perchlorate is included in the gas generant composition in a mean particle size in the range of about 350 to about 450 microns.

14. The method of claim 6 wherein the gas generant composition has an equivalence ratio in the range of about 0.95 to about 1.05.

* * * * *